US010656566B2

(12) United States Patent
Tanaka et al.

(10) Patent No.: US 10,656,566 B2
(45) Date of Patent: May 19, 2020

(54) IMAGE FORMING APPARATUS USING CONTACT MEMBER TO RECOVER TONER REMAINING ON INTERMEDIATE TRANSFER MEMBER

(71) Applicant: CANON KABUSHIKI KAISHA, Tokyo (JP)

(72) Inventors: Takayuki Tanaka, Tokyo (JP); Keisuke Ishizumi, Hiratsuka (JP); Tsuguhiro Yoshida, Yokohama (JP); Shohei Ishio, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/412,034

(22) Filed: May 14, 2019

(65) Prior Publication Data

US 2019/0369528 A1 Dec. 5, 2019

(30) Foreign Application Priority Data

May 31, 2018 (JP) ..... 2018-105104

(51) Int. Cl.
*G03G 15/16* (2006.01)

(52) U.S. Cl.
CPC ..... *G03G 15/162* (2013.01); *G03G 15/161* (2013.01)

(58) Field of Classification Search
CPC ..... G03G 15/161; G03G 15/162; G03G 2215/1661
See application file for complete search history.

(56) References Cited

U.S. PATENT DOCUMENTS 6,643,487 B1 * 11/2003 Shimmura ..... G03G 15/161 399/302
2010/0316420 A1 * 12/2010 Mori ..... G03G 15/162 399/302
2015/0177653 A1 * 6/2015 Seki ..... G03G 15/162 399/101

FOREIGN PATENT DOCUMENTS

JP 10-000698 A 1/1998
JP 2010-008729 A 1/2010
JP 2017-122852 A 7/2017

OTHER PUBLICATIONS

Machine translation of JP 2010-008729 (publication date of Jan. 14, 2010) printed on Oct. 2, 2019.*

* cited by examiner

*Primary Examiner* — Sophia S Chen
(74) *Attorney, Agent, or Firm* — Canon U.S.A., Inc. IP Division

(57) ABSTRACT

An intermediate transfer belt includes a region X having a first coefficient of dynamic friction in a belt conveying direction on an outer circumferential surface side where the intermediate transfer belt and a blade abut each other, and a region Y having a second coefficient of dynamic friction in the belt conveying direction greater in value than the first coefficient of dynamic friction. Further, in the belt conveying direction, a length of the region Y is shorter than a length of the region X and longer than a length at which the blade and the intermediate transfer belt are in contact with each other.

15 Claims, 6 Drawing Sheets

IMAGE FORMING APPARATUS USING CONTACT MEMBER TO RECOVER TONER REMAINING ON INTERMEDIATE TRANSFER MEMBER

BACKGROUND OF THE DISCLOSURE

Field of the Disclosure

The present disclosure relates to an image forming apparatus employing an electrophotographic method, such as a laser printer, a copying machine, or a facsimile machine.

Description of the Related Art

Conventionally, in a color image forming apparatus employing an electrophotographic method, an intermediate transfer method is used for sequentially transferring toner images from image forming units of respective colors onto an intermediate transfer member and further collectively transferring the toner images from the intermediate transfer member onto a transfer material.

In such an image forming apparatus, the image forming units of the respective colors include drum-like photosensitive members (hereinafter referred to as "photosensitive drums") as image bearing members. As the intermediate transfer member, an intermediate transfer belt formed of an endless belt is widely used. Toner images formed on the photosensitive drums of the respective image forming units are primarily transferred onto the intermediate transfer belt by a primary transfer power supply applying a voltage to primary transfer members provided opposed to the photosensitive drums through the intermediate transfer belt. The toner images of the respective colors primarily transferred from the image forming units of the respective colors onto the intermediate transfer belt are collectively secondarily transferred from the intermediate transfer belt onto a transfer material such as paper or an overhead projector (OHP) sheet by a secondary transfer power supply applying a voltage to a secondary transfer member at a secondary transfer portion. The toner images of the respective colors transferred onto the transfer material are then fixed to the transfer material by a fixing unit.

In the image forming apparatus using the intermediate transfer method, after the toner image is secondarily transferred from the intermediate transfer belt to the transfer material, toner (i.e., transfer residual toner) remains on the intermediate transfer belt. Thus, before toner images corresponding to the next image are primarily transferred onto the intermediate transfer belt, the transfer residual toner remaining on the intermediate transfer belt needs to be removed.

As a cleaning method for removing the transfer residual toner, a blade cleaning method is widely used. In the blade cleaning method, a cleaning blade as an abutment member that is placed downstream of the secondary transfer portion in the moving direction of the intermediate transfer belt and abuts the intermediate transfer belt scrapes off the transfer residual toner and collects the transfer residual toner in a cleaner case.

In such a blade cleaning method, the cleaning blade is often placed to constantly abut the intermediate transfer belt. In this case, after the image forming apparatus is used over a long period, a foreign substance such as paper dust may be caught in an abutment portion (i.e., a blade nip portion) between the cleaning blade and the intermediate transfer belt, whereby a cleaning failure may occur. Japanese Patent Application Laid-Open No. 2017-122852 discusses a configuration in which, to remove a foreign substance caught in a blade nip portion, when an image is not being formed, an intermediate transfer belt is moved in a direction opposite to that at a time of image formation.

In the configuration discussed in Japanese Patent Application Laid-Open No. 2017-122852, it is possible to suppress the occurrence of a cleaning failure by removing a foreign substance caught in a blade nip portion, but it is necessary to provide a driving mechanism for rotating the intermediate transfer belt backward. And thus, this may increase the cost of an image forming apparatus. Further, in a case where, to remove a foreign substance, the rotational direction of the intermediate transfer belt is switched to a direction opposite to that at a time of image formation, it is necessary to suspend image formation. And thus, this may reduce a throughput in a case where a foreign substance is removed when continuous printing is performed.

SUMMARY OF THE DISCLOSURE

The present disclosure is directed to suppressing occurrence of a cleaning failure without increasing a cost of an image forming apparatus and reducing a throughput.

According to an aspect of the present disclosure, an image forming apparatus includes an image bearing member configured to bear a toner image, a movable intermediate transfer member which is configured to abut the image bearing member and onto which the toner image borne on the image bearing member is primarily transferred, and an abutment member provided, in a moving direction of the intermediate transfer member, downstream of a secondary transfer portion that secondarily transfers the toner image primarily transferred onto the intermediate transfer member from the intermediate transfer member onto a transfer material, and configured to abut the intermediate transfer member, wherein the abutment member collects, in a collection unit, toner remaining on the intermediate transfer member after passing through the secondary transfer portion, wherein the intermediate transfer member includes a first region including a region where an entire region of the abutment member in a width direction of the intermediate transfer member that intersects the moving direction, and the intermediate transfer member are in contact with each other, and having a first coefficient of dynamic friction in the moving direction, and a second region including a region where the entire region of the abutment member in the width direction and the intermediate transfer member are in contact with each other, and having a second coefficient of dynamic friction in the moving direction greater in value than the first coefficient of dynamic friction in the moving direction, and wherein in the moving direction, a distance of the second region is greater than a distance at which the abutment member and the intermediate transfer member are in contact with each other.

Further features and aspects of the present disclosure will become apparent from the following description of embodiments with reference to the attached drawings.

DESCRIPTION OF THE EMBODIMENTS

With reference to the drawings, embodiments of the present disclosure will be described below. However, the dimensions, the materials, the shapes, and the relative arrangement of the components described in these embodiments should be appropriately changed according to the configuration of an apparatus to which the disclosure is applied, or various conditions, and are not intended to limit the scope of the disclosure to the following embodiments.

<Example Image Forming Apparatus>

Figure 1:
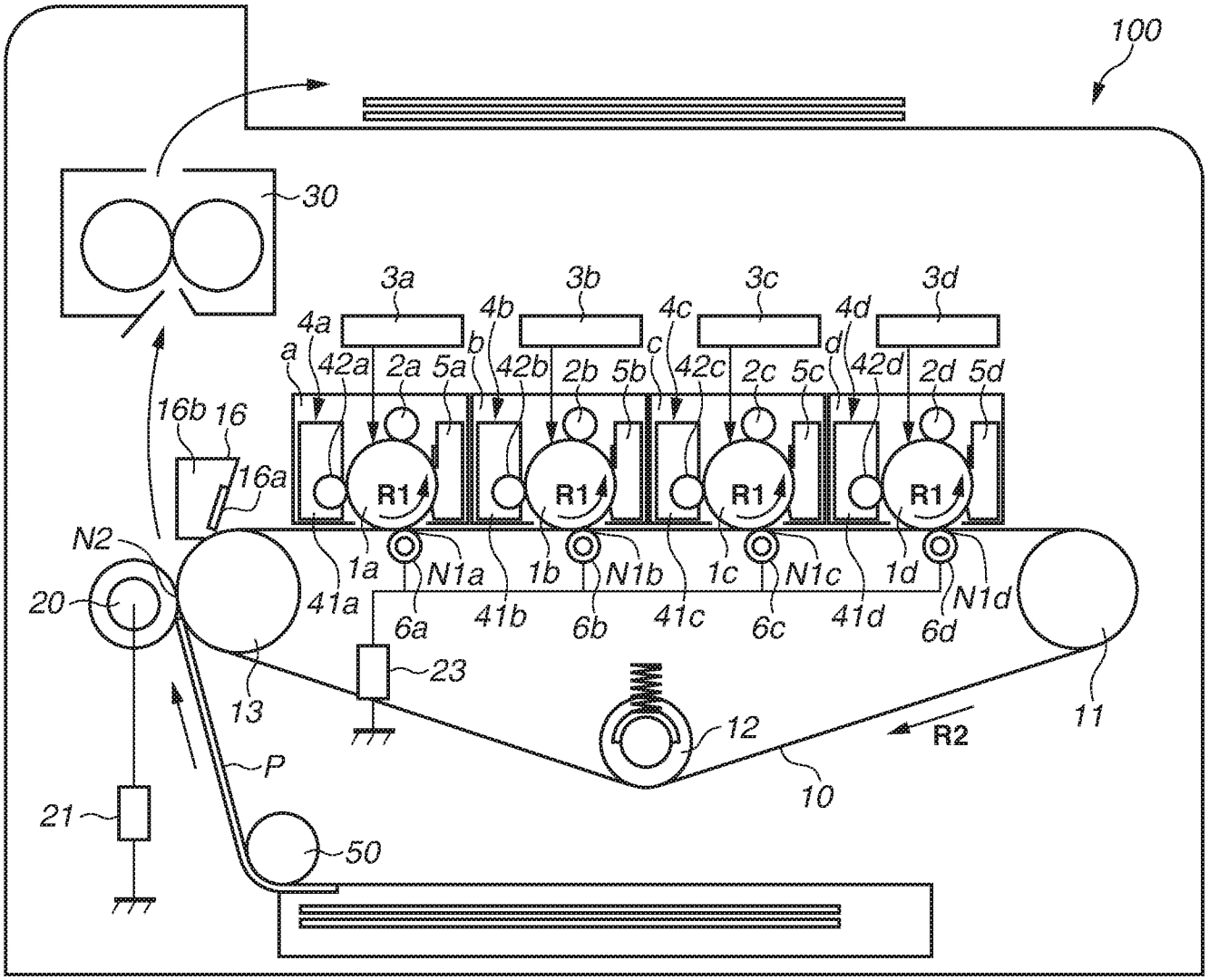
FIG. 1 is a schematic cross-sectional diagram of an example image forming apparatus according to a first embodiment.

FIG. 1 is a schematic cross-sectional diagram illustrating the configuration of an image forming apparatus 100 according to a first embodiment. The image forming apparatus 100 according to the present embodiment is a so-called tandem type image forming apparatus in which a plurality of image forming units a to d is provided. The first image forming unit a forms an image using yellow (Y) toner. The second image forming unit b forms an image using magenta (M) toner. The third image forming unit c forms an image using cyan (C) toner. The fourth image forming unit d forms an image using black (Bk) toner. The four image forming units a to d are arranged at regular intervals in a line, and many components of the image forming units a to d are substantially common except for the colors of stored toners. Thus, the image forming apparatus 100 according to the present embodiment is described below using the first image forming unit a.

The first image forming unit a includes a photosensitive drum 1*a*, which is a drum-shaped photosensitive member, a charging roller 2*a* as a charging member, a developing unit 4*a*, and a drum cleaning unit 5*a*.

The photosensitive drum 1*a* is an image bearing member that bears a toner image and is driven to rotate in the direction of an arrow R1 illustrated in FIG. 1 at a predetermined process speed (e.g., 200 mm/sec in the present embodiment). The developing unit 4*a* includes a developing container 41*a* that stores yellow toner, and a developing roller 42*a* as a developing member that bears the yellow toner stored in the developing container 41*a* and develops a yellow toner image on the photosensitive drum 1*a*. The drum cleaning unit 5*a* is a unit for collecting toner attached to the photosensitive drum 1*a*. The drum cleaning unit 5*a* includes a cleaning blade that comes into contact with the photosensitive drum 1*a*, and a waste toner box that stores toner removed from the photosensitive drum 1*a* by the cleaning blade.

When an image forming operation is started by a control unit (not illustrated) receiving an image signal, the photosensitive drum 1*a* is driven to rotate. In the rotation process, the photosensitive drum 1*a* is uniformly subjected to a charging process to a predetermined potential (i.e., a charge potential) having a predetermined polarity (e.g., a negative polarity in the present embodiment) by the charging roller 2*a* and exposed according to the image signal by an exposure unit 3*a*. Consequently, an electrostatic latent image corresponding to a yellow color component image of a target color image is formed. Next, the electrostatic latent image is developed by the developing unit 4*a* at a development position and visualized as a yellow toner image (hereinafter simply referred to as a "toner image"). A regular charge polarity of the toner stored in the developing unit 4*a* is a negative polarity. In the present embodiment, the electrostatic latent image is reversely developed using toner charged to the same polarity as the charge polarity of the photosensitive drum by the charging member. The present disclosure, however, can also be applied to an image forming apparatus that positively develops an electrostatic latent image using toner charged to a polarity opposite to the charge polarity of a photosensitive drum.

An intermediate transfer belt 10 as an endless movable intermediate transfer member is placed at the positions where the intermediate transfer belt 10 abuts the photosensitive drums 1*a* to 1*d* of the image forming units a to d. Then, the intermediate transfer belt 10 is stretched around three axes, namely a supporting roller 11, a stretching roller 12, and an opposing roller 13, as stretching members. The intermediate transfer belt 10 is stretched with tension with a total pressure of 60 N by the stretching roller 12 and moves in the direction of an arrow R2 illustrated in FIG. 1 by the rotation of the opposing roller 13 that rotates by receiving a driving force. As described below in detail, the intermediate transfer belt 10 according to the present embodiment includes a plurality of layers.

In the process where the toner image formed on the photosensitive drum 1*a* passes through a primary transfer portion N1*a* in which the photosensitive drum 1*a* and the intermediate transfer belt 10 are in contact with each other, the toner image is primarily transferred onto the intermediate transfer belt 10 by a primary transfer power supply 23 applying a voltage of a positive polarity to a primary transfer roller 6*a*. Then, toner remaining on the photosensitive drum 1*a* without being primarily transferred onto the intermediate transfer belt 10 is collected by the drum cleaning unit 5*a*, thereby being removed from the surface of the photosensitive drum 1*a*.

The primary transfer roller 6*a* is a primary transfer member (i.e., a contact member) that is provided at a position corresponding to the photosensitive drum 1*a* through the intermediate transfer belt 10 and is in contact with the inner circumferential surface of the intermediate transfer belt 10. The primary transfer power supply 23 is a power supply capable of applying a voltage of a positive polarity or a negative polarity to the primary transfer rollers 6*a* to 6*d*. In the present embodiment, a description is given of a configuration in which a common primary transfer power supply 23 applies a voltage to a plurality of primary transfer members. The present disclosure, however, is not limited to this, and can also be applied to a configuration in which a plurality of primary transfer power supplies is provided corresponding to respective primary transfer members.

In a similar manner, a magenta toner image as a second color image, a cyan toner image as a third color image, and a black toner image as a fourth color image are formed and sequentially transferred onto the intermediate transfer belt 10 one on top of another. Consequently, the toner images of the four colors corresponding to the target color image are formed on the intermediate transfer belt 10. Then, in the process where the toner images of the four colors borne on the intermediate transfer belt 10 pass through a secondary transfer portion N2 formed by a secondary transfer roller 20 and the intermediate transfer belt 10 being in contact with each other, the toner images are secondarily transferred at a time onto the surface of a transfer material P such as paper or an overhead projector (OHP) sheet fed by a sheet feeding unit 50.

The secondary transfer roller 20 is a roller having an outer diameter of 18 mm obtained by covering a nickel-plated steel rod having an outer diameter of 8 mm with a foamed sponge member containing nitrile rubber (NBR) and epichlorohydrin rubber as main components and adjusted to a volume resistivity of $10^8$ Ω·cm and a thickness of 5 mm. The rubber hardness of the foamed sponge member was 30° with a load of 500 g when measured with an ASKER Durometer Type C. The secondary transfer roller 20 is in contact with the outer circumferential surface of the intermediate transfer belt 10 and pressed with a pressure force of 50 N against the opposing roller 13 placed at a position opposed to the secondary transfer roller 20 through the intermediate transfer belt 10, thereby forming the secondary transfer portion N2.

The secondary transfer roller 20 is driven to rotate by the intermediate transfer belt 10. When a voltage is applied from a secondary transfer power supply 21 to the secondary transfer roller 20, a current flows from the secondary transfer roller 20 to the opposing roller 13. Consequently, the toner images borne on the intermediate transfer belt 10 are secondarily transferred onto the transfer material P at the secondary transfer portion N2. When the toner images on the intermediate transfer belt 10 are secondarily transferred onto the transfer material P, the voltage applied from the secondary transfer power supply 21 to the secondary transfer roller 20 is controlled so that the current flowing from the secondary transfer roller 20 to the opposing roller 13 through the intermediate transfer belt 10 becomes constant. Further, the magnitude of the current for performing the secondary transfer is determined in advance based on the surrounding environment where the image forming apparatus 100 is installed, and the type of the transfer material P. The secondary transfer power supply 21 is connected to the secondary transfer roller 20 and applies a transfer voltage to the secondary transfer roller 20. Further, the secondary transfer power supply 21 can output a voltage in the range from 100 V to 4000 V.

The transfer material P onto which the toner image of the four colors is transferred by the secondary transfer is then heated and pressurized by a fixing unit 30, whereby the toners of the four colors are melted and mixed and are fixed onto the transfer material P. Toner remaining on the intermediate transfer belt 10 after the secondary transfer is cleaned and removed by a belt cleaning unit 16 (i.e., a tonner collection unit) provided downstream of the secondary transfer portion N2 in the moving direction of the intermediate transfer belt 10. The belt cleaning unit 16 includes a cleaning blade 16*a* as an abutment member that abuts the outer circumferential surface of the intermediate transfer belt 10 at a position opposed to the opposing roller 13, and a waste toner container 16*b* that stores toner collected by the cleaning blade 16*a*. In the following description, the cleaning blade 16*a* will be simply referred to as the "blade 16*a*".

In the image forming apparatus 100 according to the present embodiment, a full-color print image is formed by the above described operation.

<Example Belt Cleaning Unit>

Figure 2A:
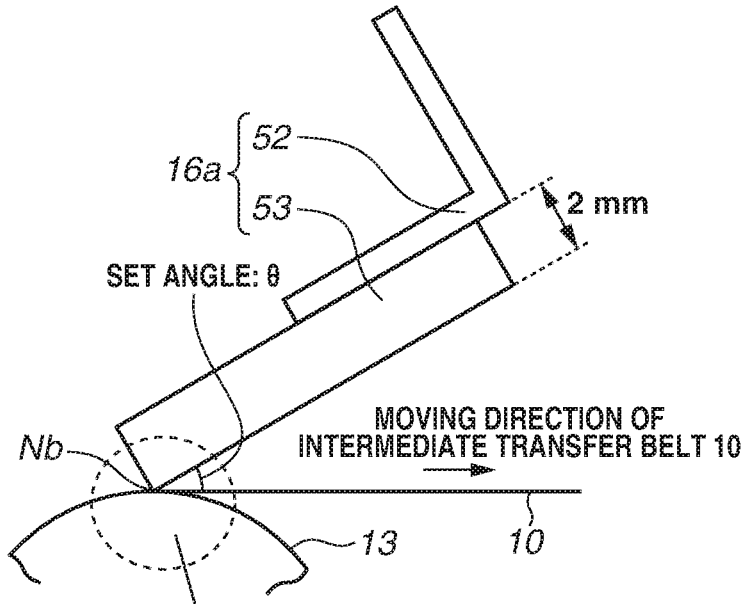
FIGS. 2A and 2B are schematic diagrams illustrating an example belt cleaning unit according to the first embodiment.
Figure 2B:
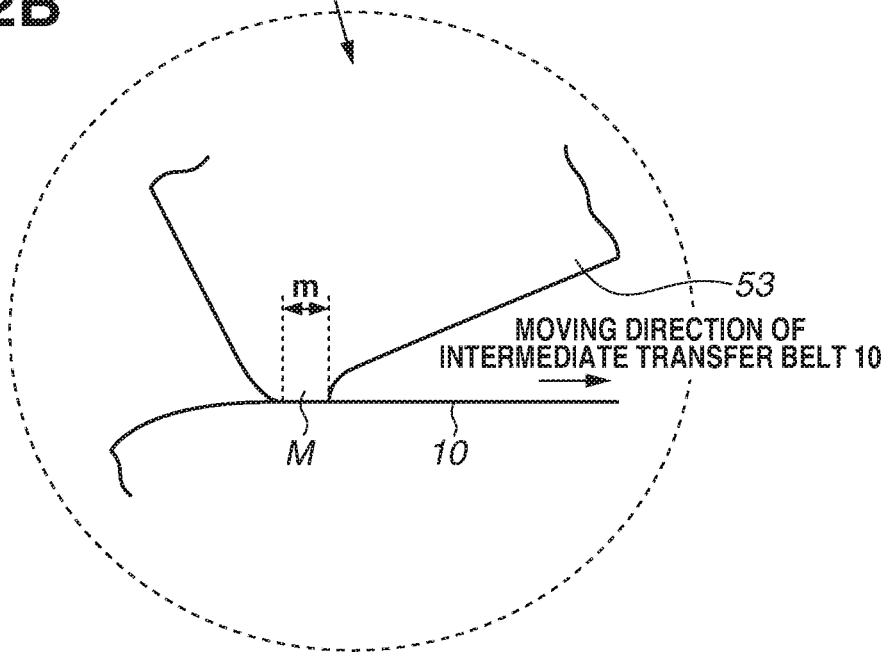

FIG. 2A is a schematic diagram illustrating the abutment state between the blade 16*a* and the intermediate transfer belt 10. FIG. 2B is an enlarged schematic diagram of the contact point between the blade 16*a* and the intermediate transfer belt 10. The blade 16*a* according to the present embodiment is a plate-like member that is long in the width direction of the intermediate transfer belt 10 (hereinafter referred to as a "belt width direction"), which intersects the moving direction of the intermediate transfer belt 10 (hereinafter referred to as a "belt conveying direction").

The blade 16*a* according to the present embodiment includes an elastic portion 53 that comes into contact with the intermediate transfer belt 10 and scrapes off toner, and a metal plate portion 52 that supports the elastic portion 53. The elastic portion 53 is a blade member formed of polyurethane. The blade 16*a* has a blade shape in which the width of the elastic portion 53 that comes into contact with the intermediate transfer belt 10 has a length of 230 mm. The blade 16*a* is formed by bonding the elastic portion 53 and the metal plate portion 52. The elastic portion 53 of the blade 16*a* has a longitudinal width of 230 mm in the belt width direction, a thickness of 2 mm, and a free length, which is the length from the bonding point with the metal plate portion 52, of 13 mm. Further, the hardness of the blade 16*a* is 77 degrees according to JIS K 6253 standard.

The opposing roller 13 is placed opposed to the blade 16*a* and on the inner circumferential side of the intermediate transfer belt 10. At the position opposed to the opposing roller 13, the blade 16*a* abuts the surface of the intermediate transfer belt 10 in a direction counter to the belt conveying direction. In other words, the blade 16*a* abuts the surface of the intermediate transfer belt 10 such that an end portion on a free end side in the short direction of the blade 16*a* is directed upstream in the belt conveying direction. Consequently, as illustrated in FIG. 2A, a blade nip portion Nb is formed between the blade 16*a* and the intermediate transfer belt 10. In the blade nip portion Nb, the blade 16*a* scrapes off toner from the surface of the intermediate transfer belt 10 that is moving, and collects the toner in the waste toner container 16*b*. In the present embodiment, the distance (i.e., the length) in the belt conveying direction of the blade nip Nb in which the blade 16*a* and intermediate transfer belt 10 are in contact with each other is 75 μm.

In the present embodiment, the blade 16*a* is placed relative to the intermediate transfer belt 10 in such a manner that a set angle θ is 22°, an entry amount is 1.5 mm, and an abutment pressure is 14 N. The set angle θ is the angle between the tangent to the opposing roller 13 at the intersection between the intermediate transfer belt 10 and the blade 16*a* (more specifically, the end surface on the free end side of the blade 16*a*) and the blade 16*a* (more specifically, one surface approximately orthogonal to the thickness direction of the blade 16*a*). The entry amount is the length in the thickness direction at which the blade 16*a* overlaps the opposing roller 13. The abutment pressure is defined by a pressing force (i.e., a linear pressure in the longitudinal direction) from the blade 16*a* in the blade nip portion Nb and measured using a film-type pressure force measurement system (product name: PINCH, manufactured by Nitta Corporation).

As illustrated in FIG. 2B, according to the configuration of the present embodiment, since the blade 16*a* is placed in the counter direction, an extremity portion of the blade 16*a* that is in contact with the intermediate transfer belt 10 receives a frictional force in the belt conveying direction. The frictional force received by the extremity portion of the blade 16*a* is a force in the direction in which the extremity portion of the blade 16*a* is bent following the belt conveying direction. This results in a shape in which, by the frictional force in the contact portion between the blade 16*a* and the intermediate transfer belt 10, the extremity portion of the blade 16*a* is curved as illustrated in FIG. 2B, and the blade 16*a* is caught in the intermediate transfer belt 10. The region of the blade 16*a* caught at this time is defined as a caught portion M. The distance (i.e., the length) of the caught portion M in the belt conveying direction is defined as a caught amount m.

The blade 16*a* holds toner remaining on the intermediate transfer belt 10 by the caught portion M of the blade 16*a*, which is caught by the frictional force between the blade 16*a* and the intermediate transfer belt 10, applying pressure to the intermediate transfer belt 10. Then, the toner held by the blade 16*a* is collected in the waste toner container 16*b*. Accordingly, to secure the property of collecting the toner, the blade 16*a* abuts the intermediate transfer belt 10 by applying a predetermined pressure to the intermediate transfer belt 10 so that the toner does not slip through the blade 16*a*.

If, however, the pressure of the blade 16*a* to the intermediate transfer belt 10 is too high, the frictional force applied to the extremity of the blade 16*a* becomes great. Accordingly, the caught amount m of the caught portion M of the blade 16*a* also becomes great. If the caught amount m is too great, the phenomenon may occur that the blade 16*a* abutting the intermediate transfer belt 10 in the counter direction enters the state where the blade 16*a* abuts the intermediate transfer belt 10 along the belt conveying direction (hereinafter referred to as a "turned-up state"). If a turned-up state occurs, it may be difficult for the blade 16*a* to hold the toner remaining on the intermediate transfer belt 10, whereby a cleaning failure may occur. Therefore, to secure the property of collecting the toner remaining on the intermediate transfer belt 10, appropriate setting of the caught amount m of the blade 16*a* is needed.

As an adjustment unit for adjusting the caught amount m of the blade 16*a*, there is a method for adjusting the coefficient of dynamic friction of the intermediate transfer belt 10, thereby adjusting the frictional force applied to the caught portion M of the blade 16*a*. For example, a plurality of grooves or a plurality of depressions and protrusions along the belt conveying direction is provided on the surface of the intermediate transfer belt 10, thereby reducing the contact area between the blade 16*a* and the intermediate transfer belt 10 and decreasing the coefficient of dynamic friction between the intermediate transfer belt 10 and the blade 16*a*. Thus, it is possible to reduce the frictional force. This can adjust the caught amount m of the blade 16*a* with respect to the intermediate transfer belt 10. Further, as an adjustment unit for adjusting the caught amount m of the blade 16*a*, there is also a method for applying a lubricant such as graphite fluoride to the extremity of the blade 16*a* in advance, thereby adjusting the frictional force applied to the caught portion M of the blade 16*a*.

<Example Intermediate Transfer Belt>

Figure 3:
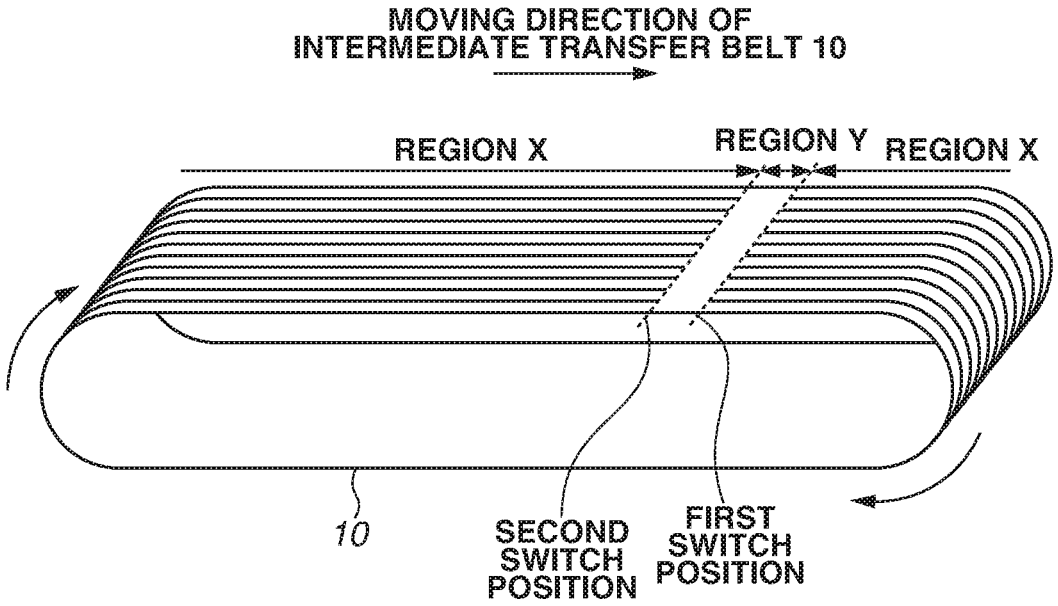
FIG. 3 is a schematic diagram illustrating an overall example configuration of an intermediate transfer belt according to the first embodiment.
Figure 4A:
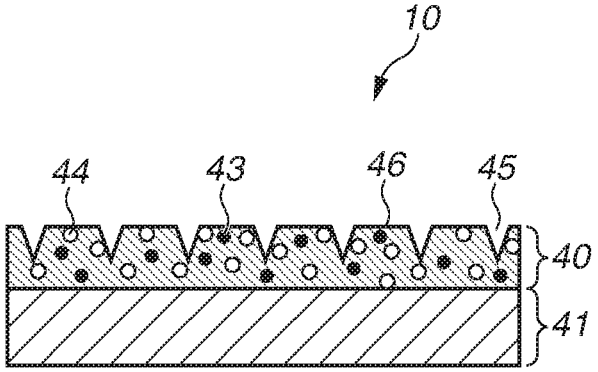
FIGS. 4A and 4B are schematic diagrams illustrating an example surface configuration in a first region of the intermediate transfer belt according to the first embodiment.
Figure 4B:
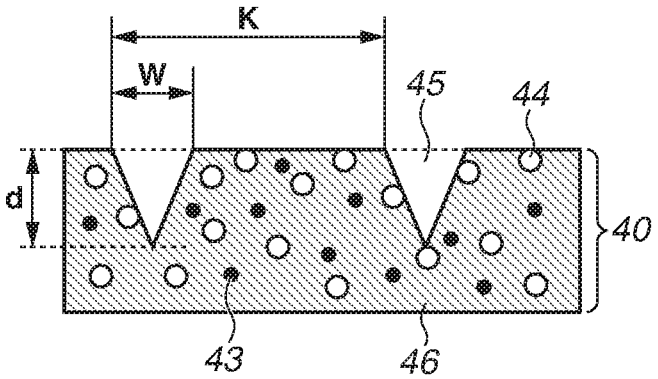

Next, the configuration of the intermediate transfer belt 10 according to the present embodiment is described. FIG. 3 is a schematic diagram illustrating the overall configuration of the intermediate transfer belt 10. FIG. 4A is a partially enlarged cross-sectional diagram of the intermediate transfer belt 10 when the intermediate transfer belt 10 is cut in a direction approximately orthogonal to the belt conveying direction (i.e., viewed along the belt conveying direction) in a region X illustrated in FIG. 3. Further, FIG. 4B illustrates in more detail a surface layer 40 of the intermediate transfer belt 10 described below at a cross section similar to that illustrated in FIG. 4A.

The intermediate transfer belt 10 is an endless belt member (or a film-like member) composed of two layers (i.e., a base layer 41 and a surface layer 40). The intermediate transfer belt 10 has a circumferential length of 700 mm and a longitudinal width of 250 mm in the belt width direction. The base layer 41 is defined as the thickest layer among the layers included in the intermediate transfer belt 10 in the thickness direction of the intermediate transfer belt 10. In the present embodiment, the base layer 41 is a layer having a thickness of 70 μm obtained by dispersing a quaternary ammonium salt, which is an ion conductive agent, as an electrical resistance adjuster in a polyethylene naphthalate resin. Further, the surface layer 40 is a layer formed on the outer circumferential surface side of the intermediate transfer belt 10. The surface layer 40 according to the present embodiment is a layer having a thickness of 3 μm obtained by dispersing antimony-doped zinc oxide as an electrical resistance adjuster 43 in an acrylic resin as a base material 46 and adding polytetrafluoroethylene (PTFE) particles, which are fluorine-containing particles, as a solid lubricant 44 to the base material 46.

The volume resistivity of the intermediate transfer belt 10 according to the present embodiment is $1\times10^{10}$ Ω·cm. The volume resistivity was measured at an applied voltage of 100 V for a measurement time of 10 seconds by connecting a UR probe (model: MCP-HTP12) to Hiresta-UP (MCP-HT450), manufactured by Mitsubishi Chemical Corporation. The environment of a measurement chamber where the volume resistivity was measured was set to a temperature of 23° C. and a humidity of 50%. Then, after the intermediate transfer belt 10 was left for four hours in the measurement chamber, the volume resistivity of was measured.

The materials of the base layer 41 and the surface layer 40 are not limited to the above, and may be other materials. In addition to the polyethylene naphthalate resin, examples of the material of the base layer 41 also include thermoplastic resins such as polycarbonates, polyvinylidene fluoride (PVDF), polyethylene, polypropylene, polymethylpentene-1, polystyrene, polyamides, polysulfones, polyarylates, polyethylene terephthalate, polybutylene terephthalate, polyethylene naphthalate, polyphenylene sulfide, polyether sulfones, polyether nitrile, thermoplastic polyimides, polyetheretherketone, thermotropic liquid-crystal polymers, and polyamide acids. Two or more of the above listed resins can also be mixed and used.

In addition to the acrylic resin, examples of the material of the surface layer 40 also include, as organic materials, hardening resins such as melamine resins, urethane resins, alkyd resins, and fluorine hardening resins (i.e., fluorine-containing hardening resins). Examples of the material of the surface layer 40 include, as inorganic materials, alkoxysilane materials, alkoxyzirconium materials, and silicate materials. Examples of the material of the surface layer 40 include, as organic-inorganic hybrid materials, inorganic particle-dispersed organic polymer materials, inorganic particle-dispersed organoalkoxysilane materials, acrylic silicon materials, and organoalkoxysilane materials.

In terms of strength such as the abrasion resistance and the crack resistance of the surface layer 40 of the intermediate transfer belt 10, resin materials (i.e., hardening resins) are desirable among hardening materials. Among the hardening resins, an acrylic resin obtained by curing an unsaturated double bond-containing acrylic copolymer is desirable. In the present embodiment, the surface layer 40 of the intermediate transfer belt 10 was obtained by applying a liquid containing ultraviolet curable monomer and/or oligomer components to the surface of the base layer 41, and by irradiating the applied liquid with an energy beam such as ultraviolet light to cure.

Examples of an electronically conductive material include granular, fibrous, or flaky carbon conductive fillers such as carbon black, polyacrylonitrile (PAN) carbon fibers, and pulverized expanded graphite. Further, examples of the electronically conductive material include granular, fibrous, or flaky metal conductive fillers such as silver, nickel, copper, zinc, aluminum, stainless steel, and iron. Further, examples of the electronically conductive material include granular metal oxide conductive fillers such as zinc antimonate, antimony-doped tin oxide, antimony-doped zinc oxide, tin-doped indium oxide, and aluminum-doped zinc oxide. Examples of an ion conductive material include ionic liquids, conductive oligomers, and quaternary ammonium salts. One or more of the above listed conductive materials may be appropriately selected, and the electronically conductive materials and the ion conductive materials may be mixed and used.

As illustrated in FIGS. 3, 4A, and 4B, the intermediate transfer belt 10 according to the present embodiment includes a region X (i.e., a first region) where the surface layer 40 is subjected to a surface treatment process to suppress the abrasion of the blade 16*a*, and a region Y (i.e., a second region) where the surface layer 40 is not subjected to the surface treatment process. The regions X and Y are regions continuously formed in the entire region where the blade 16*a* and the intermediate transfer belt 10 abut each other in the belt width direction orthogonal to the belt conveying direction.

Further, as illustrated in FIG. 3, the intermediate transfer belt 10 includes a single first switch position where the region X switches to the region Y in the belt conveying direction, and a single second switch position where the region Y switches to the region X. In other words, the intermediate transfer belt 10 includes a single region X continuously formed in the belt conveying direction and a single region Y continuously formed in the belt conveying direction. In the following description, with respect to the belt conveying direction, the distance from the first switch position to the second switch position is defined as the length of the region Y, and the distance from the second switch position to the first switch position is defined as the length of the region X. In the present embodiment, the length of the region Y is 5 mm, and the length of the region X is 695 mm.

In the present embodiment, in the region X, a plurality of grooves (groove shapes or groove portions) 45 along the belt conveying direction is formed in the belt width direction. Meanwhile, the grooves 45 are not formed in the region Y. With the configuration of grooves in the region X and Y, in the intermediate transfer belt 10 according to the present embodiment, the value of the coefficient of dynamic friction in the region Y is greater than the value of the coefficient of dynamic friction in the region X. As illustrated in the schematic diagram in FIG. 3, in the region X, the grooves 45 are continuously formed without interruption in the belt conveying direction.

With reference to FIGS. 4A and 4B, the configuration of the grooves 45 formed on the intermediate transfer belt 10 in the region X is described below. The shapes of the grooves 45 in the following description were measured using L-trace II and NanoNavi II (manufactured by SII NanoTechnology Inc.) and using high aspect probe SI-40H as a cantilever in a dynamic force mode (DFM).

As illustrated in FIG. 4B, a width W of an opening portion (hereinafter simply referred to as a "width W") of each groove 45 in a direction (i.e., the belt width direction) approximately orthogonal to a longitudinal axial direction is 1 μm. In the thickness direction of the intermediate transfer belt 10, a depth d from the surface of the surface layer 40 on which grooves are not formed (i.e., the opening portion) to a bottom portion of the groove 45 (hereinafter simply referred to as a "depth d") is 2 μm. An interval K between the grooves 45 in a direction approximately orthogonal to the belt conveying direction is 20 μm.

In terms of cleaning performance, it is desirable that the width W of the groove 45 should be a width up to about half the average particle diameter of toner. If the width W of the groove 45 is too great, toner fitted in the groove 45 may slip through the blade nip portion Nb, whereby a cleaning failure may occur. If the width W of the groove 45 is too small, the contact area between the blade 16*a* and the intermediate transfer belt 10 may be too great, whereby friction in the blade nip portion Nb may be great and promote the abrasion of the extremity of the blade 16*a*. Therefore, in the configuration of the present embodiment, it is desirable to set the width W of the groove 45 to 0.5 μm or more and 3 μm or less.

In the present embodiment, since the thickness of the surface layer 40 is 3 μm, the groove 45 does not reach the base layer 41, and is present only in the surface layer 40. Further, the groove 45 is continuously formed over the entire region of a round of the intermediate transfer belt 10 along the circumferential direction (i.e., the rotational direction) of the intermediate transfer belt 10. In the present embodiment, groove shapes were given to the surface of the intermediate transfer belt 10 by pressing a metal mold in which protruding shapes were formed on its surface, against the surface layer 40.

The thickness of the surface layer 40 needs to be greater than or equal to the depth d of the groove 45 so that the groove 45 can be formed. If the thickness of the surface layer 40 is smaller than the depth d of the groove 45, the groove 45 reaches the base layer 41, and a substance added to the base layer 41 may deposit on the surface of the surface layer 40, whereby a cleaning failure may occur. If, on the other hand, the thickness of the surface layer 40 is too great, the surface layer 40 composed of an acrylic resin may be broken, whereby a cleaning failure may occur. Therefore, in the configuration of the present embodiment, it is desirable to set the thickness of the surface layer 40 to 1 μm or more and 5 μm or less. In view of the breakage of the surface layer 40 in long-term use, it is more desirable to set the thickness of the surface layer 40 to 1 μm or more and 3 μm or less.

As described above, in the present embodiment, the region X where the grooves 45 are formed is provided, thereby reducing the contact area between the blade 16*a* and the intermediate transfer belt 10. This adjusts the coefficient of dynamic friction of the intermediate transfer belt 10, thereby adjusting the frictional force applied to the caught portion M of the blade 16*a*. With this configuration, the abrasion of the blade 16*a* can be suppressed. In the present embodiment, in the belt width direction, the grooves 45 are formed in a range wider than the width of the blade 16*a*. In other words, the intermediate transfer belt 10 has a configuration in which the widths of the regions X and Y are greater than the width of the blade 16*a* in the belt width direction. This can stably suppress the abrasion of the blade 16*a* in the entire region of the width of the blade 16*a*.

<Removal of Foreign Substance in Blade Nip Portion>

As illustrated in FIG. 3, the intermediate transfer belt 10 according to the present embodiment includes the region X where the grooves 45 are formed on the surface layer 40, and the region Y where the grooves 45 are not formed on the surface layer 40. In other words, part of the intermediate transfer belt 10 is subjected to groove processing. In the region X, the grooves 45 reduce the contact area between the blade 16*a* and the intermediate transfer belt 10, and increase the surface area of the intermediate transfer belt 10, thus increasing the exposed area of the solid lubricant 44. Consequently, the coefficient of dynamic friction between the blade 16*a* and the intermediate transfer belt 10 in the region X is reduced.

In Table 1, the coefficient of dynamic friction and the magnitude of the caught amount m are compared between the regions X and Y. The coefficient of dynamic friction and the caught amount m corresponding to each of the regions X and Y were obtained by measuring an intermediate transfer belt in which the grooves 45 were formed over its entire surface in the belt conveying direction (i.e., including only the region X) and an intermediate transfer belt on which the grooves 45 were not formed (i.e., including only the region Y).

TABLE 1

| | Region Y | Region X |
|---|---|---|
| Coefficient of Dynamic Friction | 1.02 | 0.75 |
| Caught Amount m | 25 μm | 10 μm |

The coefficient of dynamic friction was measured using a surface property testing machine ("Heidon 14FW", manufactured by SHINTO Scientific Co., ltd.) and using a urethane rubber ball indenter (an outer diameter of ⅜ inches and a rubber hardness of 90 degrees) as a measurement indenter. The measurement conditions were a test load of 50 gf, a speed of 10 mm/sec, and a measurement distance of 50 mm. Values of the coefficient of dynamic friction in table 1 were obtained by dividing the average value of frictional forces (gf) measured from the measurement start to one to four seconds later by the test load (gf).

The magnitude of the caught amount m of the blade 16*a* was measured as follows. First, the blade 16*a* in which graphite fluoride was applied to an extremity portion thereof was installed against the intermediate transfer belt 10, and the image forming apparatus 100 was operated for two minutes in a state where an image was not formed. Then, the blade 16*a* was detached from the image forming apparatus 100, and the extremity portion of the blade 16*a* was observed with a microscope. Further, the width of a portion in which the graphite fluoride applied to the extremity portion of the blade 16*a* was peeled off by the blade 16*a* rubbing against the intermediate transfer belt 10 was measured. Then, the measured width was determined as the caught amount m.

As illustrated in table 1, if the coefficient of dynamic friction changes, the caught amount m changes. In other words, according to the intermediate transfer belt 10 including the region X having a first coefficient of dynamic friction and the region Y having a second coefficient of dynamic friction greater in value than the first coefficient of dynamic friction, the caught amount m of the blade 16*a* in the blade nip portion Nb can be changed.

Figure 5A:
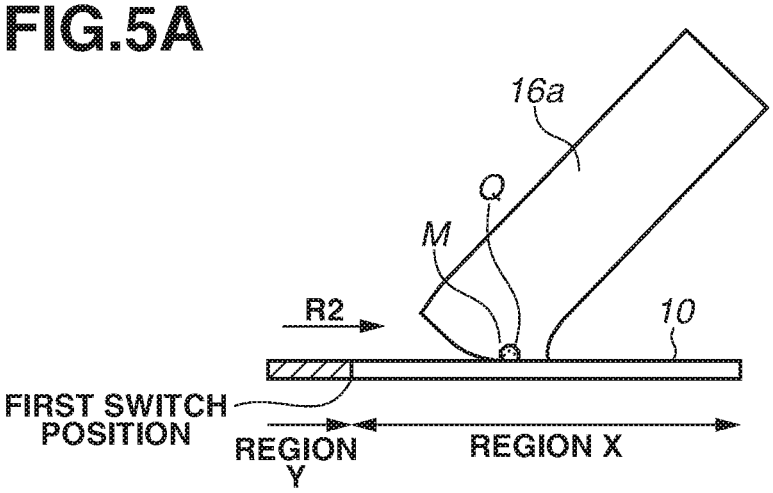
FIGS. 5A, 5B, and 5C are schematic diagrams illustrating how to remove a foreign substance on the intermediate transfer belt according to the first embodiment.
Figure 5B:
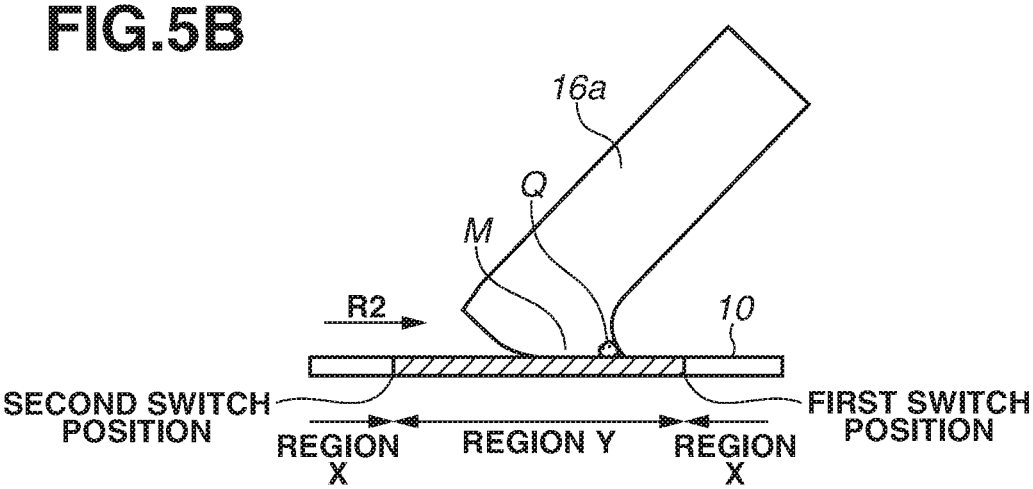
Figure 5C:
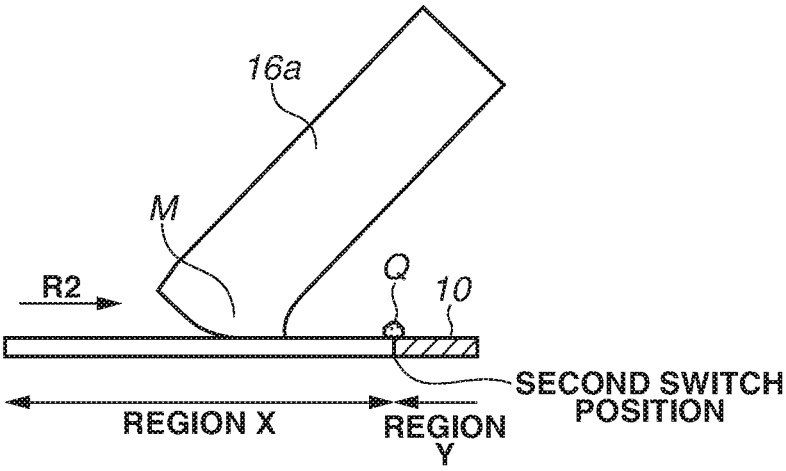

FIG. 5A is a schematic enlarged cross-sectional view illustrating the state where the blade 16*a* abuts the region X in the blade nip portion Nb. FIG. 5B is a schematic enlarged cross-sectional view illustrating the state where the blade 16*a* abuts the region Y after the blade 16*a* passes through the first switch position by the movement of the intermediate transfer belt 10. FIG. 5C is a schematic enlarged cross-sectional view illustrating the state where the blade 16*a* abuts the region X again after the blade 16*a* passes through the second switch position by the movement of the intermediate transfer belt 10.

Figure 6:
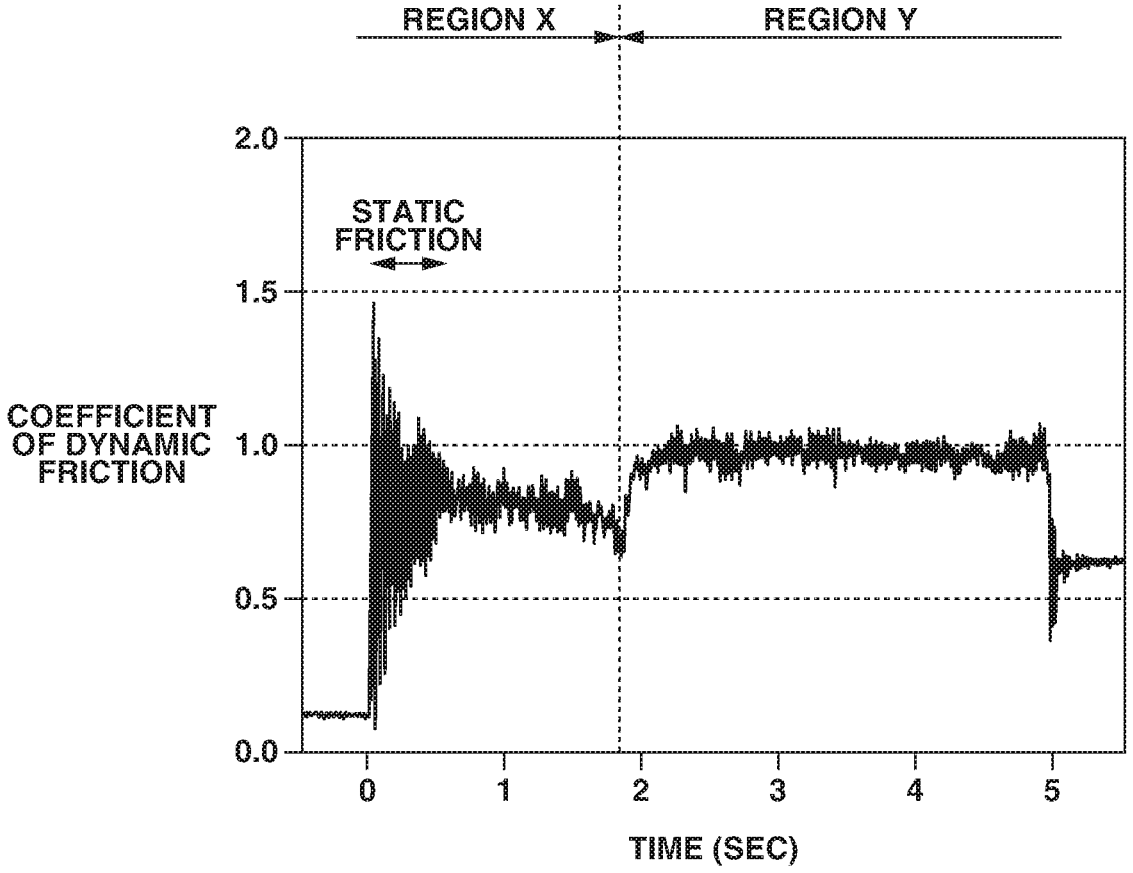
FIG. 6 is a graph illustrating a result of measuring a coefficient of dynamic friction at a boundary between first and second regions of the intermediate transfer belt according to the first embodiment.

When the blade 16*a* passes through the region X, the shape of the caught portion M of the blade 16*a* is as illustrated in FIG. 5A. As illustrated in FIG. 5B, if the intermediate transfer belt 10 makes a circling movement, the blade 16*a* passes through the first switch position and then enters the state where the blade 16*a* is in contact with the region Y. FIG. 6 illustrates the results of continuous measuring of the coefficient of dynamic friction from the region X to the region Y. As illustrated in FIG. 6, the coefficient of dynamic friction increases at the position where the region X switches to the region Y (i.e., the first switch position). As a result, as illustrated in FIG. 5B, the shape of the caught portion M of the blade 16*a* deforms, and the caught amount m becomes great. When the blade 16*a* enters the state where the blade 16*a* abuts the region X again, then, the shape of the caught portion M returns to the initial shape as illustrated in FIG. 5C.

As described above, the blade 16*a* passes through the first and second switch positions, whereby the shape of the caught portion M of the blade 16*a* changes, and the magnitude of the caught amount m changes. Accordingly, the contact state between the blade 16*a* and the intermediate transfer belt 10 is changed. As a result, as illustrated in FIGS. 5A to 5C, a foreign substance Q such as paper dust caught in the blade nip portion Nb is removed.

If the foreign substance Q is not removed in the state where the foreign substance Q is caught in the blade nip portion Nb, the abutment state of the blade 16*a* with the intermediate transfer belt 10 may become unstable, whereby a cleaning failure may occur. Conventionally, a method to switch the moving direction of the intermediate transfer belt 10 for removing the foreign substance Q caught in the blade nip portion Nb is known. According to the configuration of the present embodiment, however, by changing the caught amount m of the caught portion M of the blade 16*a* by the movement of the intermediate transfer belt 10, the foreign substance Q can be removed. Therefore, unlike the conventional configuration, it is not necessary to move the intermediate transfer belt 10 in a direction opposite to that at a time of image formation. In other words, it is not necessary to provide a driving mechanism for moving the intermediate transfer belt 10 in the opposite direction or to suspend image formation for the opposite moving.

In the present embodiment, with respect to the belt conveying direction, the length of the region Y is set to be greater than the length of the blade nip portion Nb and shorter than the length of the region X. With respect to the belt conveying direction, the entire region of the blade nip portion Nb enters the region Y, whereby the shape of the caught portion M of the blade 16*a* changes, and the foreign substance Q can be removed. Thus, the length of the region Y needs to be greater than the length of the blade nip portion Nb. On the other hand, with respect to the belt conveying direction, if the length of the region Y is longer than the length of the region X, the region Y where the coefficient of dynamic friction is great is in contact with the blade 16*a* for a long time, whereby the blade 16*a* may be likely to be abraded, and a cleaning failure may be likely to occur. Thus, the length of the region Y needs to be shorter than the length of the region X in the belt conveying direction.

As described above, according to the configuration of the present embodiment, the occurrence of a cleaning failure can be suppressed without increasing the cost of an image forming apparatus or reducing a throughput.

If the amount of change in the caught amount m of the caught portion M of the blade 16*a* is comparable with the foreign substance Q, the foreign substance Q can be effectively removed. Since the size of paper dust, which is a typical material of foreign substance Q, is about several micrometers, it is desirable to set the amount of change in the caught amount m to the similar size as that of the paper dust. With respect to the belt width direction, it is desirable to form the width of the region Y to be greater than the width of the blade 16*a*. This is because if the width of the region Y is greater than the width of the blade nip portion Nb, it is possible to greatly move the caught portion M by moving the entirety of the blade 16*a* when the blade 16*a* passes through the first switch position.

<Evaluation of Cleaning Performance>

Next, in the image forming apparatus 100, the cleaning performance of each of the intermediate transfer belt 10 according to the present embodiment and intermediate transfer belts in comparative examples 1 and 2 was evaluated. In comparative example 1, an intermediate transfer belt was used in which grooves were not formed on a surface thereof and which had a uniform coefficient of dynamic friction in the entire region in the belt conveying direction. In comparative example 2, an intermediate transfer belt was used in which grooves were formed on a surface thereof and which had a uniform coefficient of dynamic friction in the entire region in the belt conveying direction.

As the evaluation of the cleaning performance, in durability evaluation where a character image with 1% of each color was formed in a two-sheet intermittent mode, an image for confirming the occurrence of a cleaning failure was formed every 5000 sheets, using letter size sheets (trademark: Vitality, manufactured by Xerox Corporation). The evaluation was performed under an environment with a temperature of 15° C. and a humidity of 10%.

The confirmation of the occurrence of a cleaning failure every 5000 sheets in the above described durability evaluation was made using the following method. First, a red solid image (i.e., a solid image with 100% of yellow and 100% of magenta) is formed in a state where the output from the secondary transfer power supply 21 is off (0 V). Then, the output from the secondary transfer power supply 21 is set to an appropriate value, and five transfer materials P on which an image is not formed are successively passed. In other words, it is confirmed whether the toner of the red solid image that remains by hardly being transferred onto the transfer materials P at the secondary transfer portion N2 is removed by the blade 16*a*, thereby confirming the presence or absence of the occurrence of a cleaning failure.

If the toner of the red solid image is successfully removed from the intermediate transfer belt 10, the five transfer materials P that are successively passed are output in a substantially complete blank state. On the other hand, if the removal of the toner of the red solid image is failed, toner slipping through the blade 16*a* reaches the secondary transfer portion N2 again, whereby the toner is transferred onto the five transfer materials P that are successively passed, and is output as cleaning failure images. The confirmation of the occurrence of a cleaning failure as described above was made every time 5000 transfer materials P were passed, and the cleaning performance was evaluated regarding 100000 transfer materials P.

As a result of the evaluation of the cleaning performance, in the configuration of the present embodiment, a cleaning failure did not occur up to 100000 materials. However, in the configuration of comparative example 1, a cleaning failure occurred after 20000 materials were passed. In the configuration of comparative example 2, a cleaning failure occurred after 50000 materials were passed.

When the extremity of a cleaning blade used in comparative example 1 was observed with a microscope, urethane rubber was abraded due to friction with the intermediate transfer belt 10, and an extremity portion of the cleaning blade was chipped off. This is because the coefficient of dynamic friction between the intermediate transfer belt 10 and the cleaning blade is great, whereby the cleaning blade is likely to be abraded in a blade nip portion. Further, when the extremity of a cleaning blade used in comparative example 2 was observed with a microscope, it was confirmed that paper dust generated from the transfer materials P was attached to the extremity of the cleaning blade. Since the intermediate transfer belt in comparative example 2 had a uniform coefficient of dynamic friction in the entire region in the belt conveying direction, it was considered that paper dust deposited in a blade nip portion, and transfer residual toner slipped through the blade nip portion.

As described above, a region different in the coefficient of dynamic friction is formed in a part of the intermediate transfer belt 10, thereby changing the contact state of the blade 16*a* and causing a foreign substance caught in a blade nip portion to slip through the blade nip portion, whereby the occurrence of a cleaning failure can be suppressed.

(Other Example Embodiments)

In the first embodiment, a configuration has been employed in which the grooves 45 are not formed in the region Y of the intermediate transfer belt 10. The present disclosure, however, is not limited to the configuration. Specifically, if the value of the coefficient of dynamic friction in the region Y is greater than the value of the coefficient of dynamic friction in the region X, then similarly to the first embodiment, the foreign substance Q can be removed by changing the caught amount m of the blade 16*a*. Thus, for example, a configuration may be employed in which grooves are formed in the region Y of the intermediate transfer belt 10 less densely than grooves formed in the region X, thereby varying the coefficient of dynamic friction.

In the first embodiment, to change the coefficient of dynamic friction of the intermediate transfer belt 10, processing for forming the grooves 45 on the surface layer 40 in the region X is performed. Alternatively, as another method, a method for changing polishing intensity is also possible. Specifically, the region X on the outer circumferential surface of the intermediate transfer belt 10 is polished with a coarse lapping film (Lapika #2000 (product name), manufactured by KOVAX Corporation), and the region Y is polished with a fine lapping film (Lapika #10000 (product name), manufactured by KOVAX Corporation). In the region polished with the coarse lapping film, the surface roughness is greater than that in the region polished with the fine lapping film, and the exposed area of the solid lubricant also increases. Accordingly, the coefficient of dynamic friction can be small.

As another method for changing the coefficient of dynamic friction between the regions X and Y, there is also a method for spraying a coating liquid including lubricating particles to the region X. In the sprayed portion, the surface roughness is great, and the exposed area of the solid lubricant also increases. Accordingly, the coefficient of dynamic friction can be small.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2018-105104, filed May 31, 2018, which is hereby incorporated by reference herein in its entirety.

What is claimed is:

1. An image forming apparatus comprising:

an image bearing member configured to bear a toner image;

a movable intermediate transfer member configured to abut the image bearing member and onto which the toner image borne on the image bearing member is primarily transferred; and an abutment member provided downstream, in a moving direction of the intermediate transfer member, of a secondary transfer portion at which the toner image that is primarily transferred onto the intermediate transfer member is secondarily transferred from the intermediate transfer member onto a transfer material, and configured to, in a state where an abutment portion abutting the intermediate transfer member is formed, collect toner remaining on the intermediate transfer member after passing through the secondary transfer portion, wherein the intermediate transfer member includes, in the moving direction, a first region including a region where at least the abutment portion is formed in the width direction, and a second region different from the first region and including a region where at least the abutment portion is formed in the width direction, wherein a coefficient of dynamic friction in the moving direction in the second region is greater than a coefficient of dynamic friction in the moving direction in the first region, and wherein a length of the second region in the moving direction is shorter than a length of the first region in the moving direction and longer than a length of the abutment portion in the moving direction.

2. The image forming apparatus according to claim 1, wherein the intermediate transfer member is an endless belt member, and in the moving direction, a single first switch position where the first region switches to the second region, and a single second switch position where the second region switches to the first region are formed on the intermediate transfer member.

3. The image forming apparatus according to claim 2, wherein, in the moving direction, a distance from the first switch position to the second switch position is the length of the second region, and a distance from the second switch position to the first switch position is the length of the first region.

4. The image forming apparatus according to claim 1, wherein the first region includes a plurality of grooves in the width direction, and each of the plurality of grooves extends along the moving direction.

5. The image forming apparatus according to claim 4, wherein in the first region, the plurality of grooves is continuously formed in the moving direction.

6. The image forming apparatus according to claim 4, wherein in the second region of the intermediate transfer member, a plurality of grooves along the moving direction is not formed in the width direction.

7. The image forming apparatus according to claim 1, wherein the first region has a first coefficient of dynamic friction in the moving direction, the second region has a second coefficient of dynamic friction in the moving direction, and a difference between a value of the first coefficient of dynamic friction and a value of the second coefficient of dynamic friction is 0.05 or more.

8. The image forming apparatus according to claim 1, wherein a value of surface roughness in the second region is smaller than a value of surface roughness in the first region.

9. The image forming apparatus according to claim 1, wherein the intermediate transfer member includes, in a thickness direction of the intermediate transfer member, a base layer that is the thickest among a plurality of layers included in the intermediate transfer member, and a surface layer formed on a surface of the base layer, and wherein the base layer is a layer to which an ion conductive agent is added, and wherein the first and second regions are regions formed on the surface layer.

10. The image forming apparatus according to claim 9, wherein a thickness of the surface layer is 3 μm or less.

11. The image forming apparatus according to claim 9, wherein the surface layer is formed of an acrylic copolymer.

12. The image forming apparatus according to claim 9, wherein fluorine-containing particles are added to the surface layer.

13. The image forming apparatus according to claim 12, wherein the fluorine-containing particles are polytetrafluoroethylene (PTFE).

14. The image forming apparatus according to claim 13, wherein the abutment member is a blade formed of polyurethane.

15. The image forming apparatus according to claim 1, wherein the abutment member abuts the intermediate transfer member in a counter direction.

* * * * *